US007963356B2

(12) United States Patent
Zahora et al.

(10) Patent No.: US 7,963,356 B2
(45) Date of Patent: Jun. 21, 2011

(54) LOCOMOTIVE-RADIATOR-COOLING-FAN TANKHEAD ASSEMBLY

(75) Inventors: Joseph A. Zahora, Kettering, OH (US); Johnny D. Yu, Centerville, OH (US)

(73) Assignee: Dayton-Phoenix Group, Inc., Dayton, OH (US)

( * ) Notice: Subject to any disclaimer, the term of this patent is extended or adjusted under 35 U.S.C. 154(b) by 441 days.

(21) Appl. No.: 12/255,929

(22) Filed: Oct. 22, 2008

(65) Prior Publication Data

US 2009/0304535 A1 Dec. 10, 2009

Related U.S. Application Data

(60) Provisional application No. 61/060,219, filed on Jun. 10, 2008.

(51) Int. Cl.
*B60K 11/04* (2006.01)

(52) U.S. Cl. ..... 180/68.4

(58) Field of Classification Search ..... 180/68.4, 180/68.6

See application file for complete search history.

(56) References Cited

U.S. PATENT DOCUMENTS

| | | | | |
|---|---|---|---|---|
| 4,219,325 | A * | 8/1980 | Gutzwiller | 432/199 |
| 4,318,693 | A * | 3/1982 | Gutzwiller | 432/201 |
| 5,088,572 | A * | 2/1992 | Schroeder et al. | 180/300 |
| 6,871,697 | B2 * | 3/2005 | Albright et al. | 165/51 |
| 6,908,284 | B2 * | 6/2005 | Adrian | 416/134 R |
| 2003/0150859 | A1 * | 8/2003 | Reutter | 220/203.23 |
| 2009/0304535 | A1 * | 12/2009 | Zahora et al. | 417/423.14 |

* cited by examiner

*Primary Examiner* — Jeffrey J Restifo
(74) *Attorney, Agent, or Firm* — Thompson Hine LLP

(57) ABSTRACT

Apparatus including a locomotive-radiator-cooling-fan tankhead assembly having a substantially-circular base plate and a substantially-circular outer ring. The base plate has a central longitudinal axis and a circumference. The outer ring is substantially coaxially aligned with the central longitudinal axis and is attached to the base plate proximate the circumference. The base plate has a substantially-planar first surface having a central recess substantially coaxially aligned with the central longitudinal axis and having circumferentially-separated, first and second peripheral recesses each radially spaced apart from the central recess and extending radially inward from proximate the circumference. The outer ring longitudinally extends beyond the first surface. The tankhead assembly is devoid of any gussets attached to the base plate and is devoid of any gussets attached to the outer ring.

20 Claims, 4 Drawing Sheets

LOCOMOTIVE-RADIATOR-COOLING-FAN TANKHEAD ASSEMBLY

CROSS REFERENCE TO RELATED APPLICATIONS

The present application claims priority of U.S. Provisional Application No. 61/060,219 filed Jun. 10, 2008.

TECHNICAL FIELD

The present invention relates generally to locomotives, and more particularly to a locomotive-radiator-cooling-fan tankhead assembly.

BACKGROUND OF THE INVENTION

Conventional tankhead assemblies of locomotive radiator cooling fans are made of steel and consist of a circular base plate, a circular inner ring, a circular outer ring, and a plurality of gussets. The inner and outer rings are welded to a substantially-planar first surface of the base plate. The base plate and the outer ring have a thickness of ⅜-inch, and the base plate has a diameter of 24 or 26 inches. The process of assembling a locomotive radiator cooling fan includes welding non-rotatable steel vanes to the outer ring of the tankhead assembly and bolting a fan-motor stator assembly to the base plate of the tankhead assembly, wherein an annular fan-frame steel ring surrounds and is welded to the vanes, wherein a steel hub assembly, having steel fan blades, is attached to the fan-motor rotor assembly, and wherein the fan-frame ring surrounds, and is spaced apart from, the tips of the fan blades. Motor-low-speed electric wiring passes through a first hole in the outer ring between a pair of gussets and is attached to the fan motor. Motor-high-speed electric wiring passes through a non-diametrically-opposed second hole in the outer ring between a different pair of gussets and is attached to the fan motor. Each of the two wirings is surrounded by a corresponding tube extending radially between the outer ring of the tankhead assembly and the fan-frame ring.

What is needed is an improved locomotive-radiator-cooling-fan tankhead assembly.

SUMMARY OF THE INVENTION

A first expression of an embodiment of the invention is for apparatus including a locomotive-radiator-cooling-fan tankhead assembly. The tankhead assembly has a substantially-circular base plate and a substantially-circular outer ring. The base plate and the outer ring each consist essentially of an aluminum alloy. A maximum diameter of the base plate divided by a maximum thickness of the base plate is between 5 and 15, and the maximum diameter of the base plate divided by a maximum thickness of the outer ring is between 20 and 30. The base plate has a central longitudinal axis and a circumference. The outer ring is substantially coaxially aligned with the central longitudinal axis and is attached to the base plate proximate the circumference. The base plate has a substantially-planar first surface having a central recess substantially coaxially aligned with the central longitudinal axis and having circumferentially-separated, first and second peripheral recesses each radially spaced apart from the central recess and extending radially inward from proximate the circumference. The outer ring longitudinally extends beyond the first surface. The tankhead assembly is devoid of any gussets attached to the base plate and is devoid of any gussets attached to the outer ring.

A second expression of an embodiment of the invention is for apparatus including a locomotive-radiator-cooling-fan tankhead assembly. The tankhead assembly has a substantially-circular base plate and a substantially-circular outer ring. The base plate has a central longitudinal axis and a circumference. The outer ring is substantially coaxially aligned with the central longitudinal axis and is attached to the base plate proximate the circumference. The base plate has a substantially-planar first surface having a central recess substantially coaxially aligned with the central longitudinal axis and having circumferentially-separated, first and second peripheral recesses each radially spaced apart from the central recess and extending radially inward from proximate the circumference. The outer ring longitudinally extends beyond the first surface. The tankhead assembly is devoid of any gussets attached to the base plate and is devoid of any gussets attached to the outer ring.

Several benefits and advantages are derived from one or both of the expressions of the embodiment of the invention. In one example, a lighter-weight tankhead assembly (and a lighter-weight locomotive radiator cooling fan) is provided using an aluminum alloy (or other lighter-weight material than conventional steel). It is noted that applicants' shock and vibration testing of a conventional locomotive radiator cooling fan, having a conventional tankhead assembly design, which replaced the steel with an aluminum alloy for the tankhead assembly, the vanes, the fan-frame ring, and the hub assembly including the blades resulted in the tankhead assembly exhibiting a wobble mode during a static (motor switched off) vibration test of the cooling fan, wherein the test subjected the cooling fan to eight hours of 2-g load vibration at resonance frequencies and resulted in undesirable contact of the fan blade tips with the surrounding fan-frame ring. It is also noted that the same test using the tankhead assembly design of the first expression of the embodiment of the invention together with thicker vanes resulted a greatly reduced wobble mode without any contact of the fan blade tips with the surrounding fan-frame ring.

DETAILED DESCRIPTION

Figure 1:
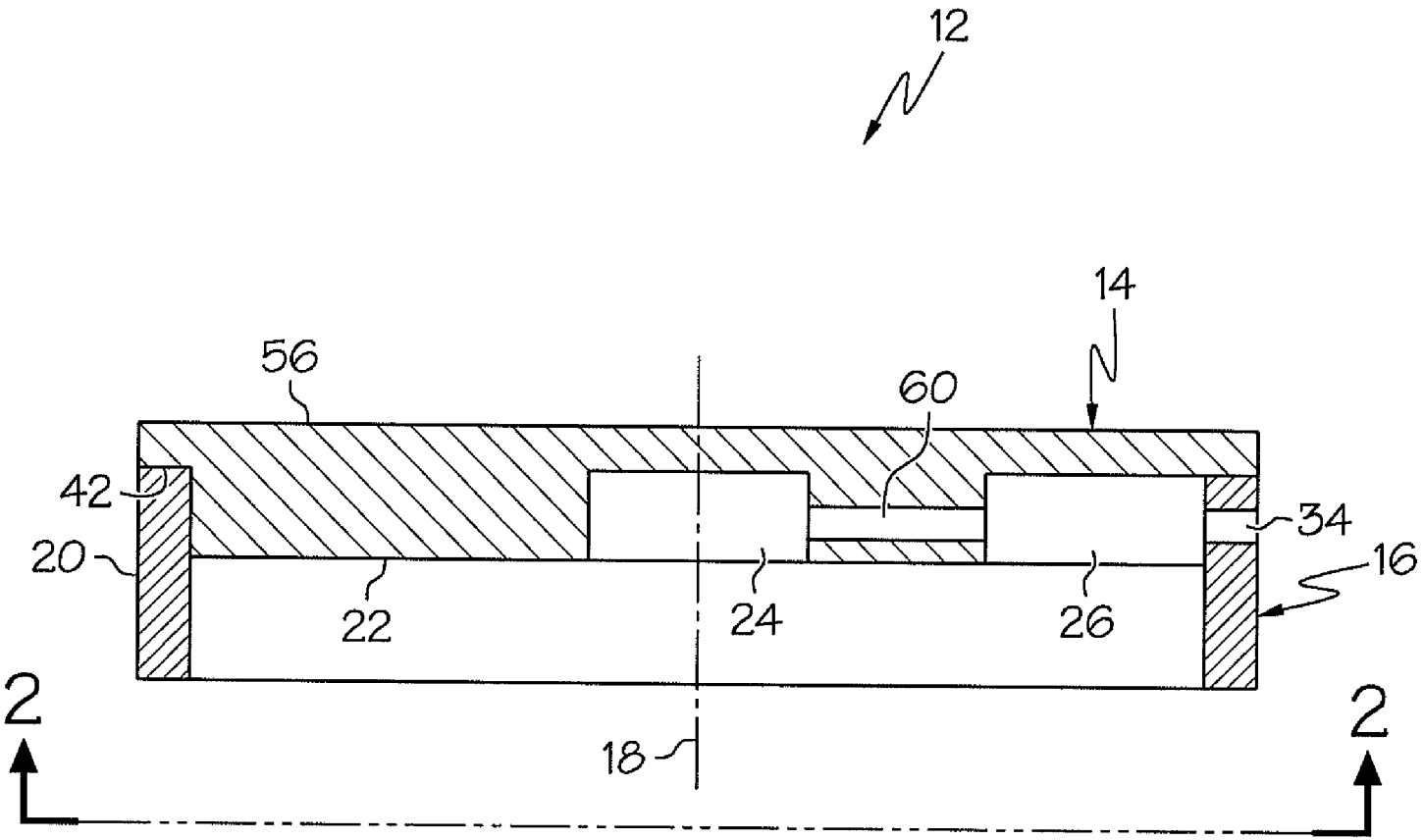
FIG. 1 is a cross-sectional side view of an embodiment of the locomotive-radiator-cooling-fan tankhead assembly of the invention.
Figure 2:
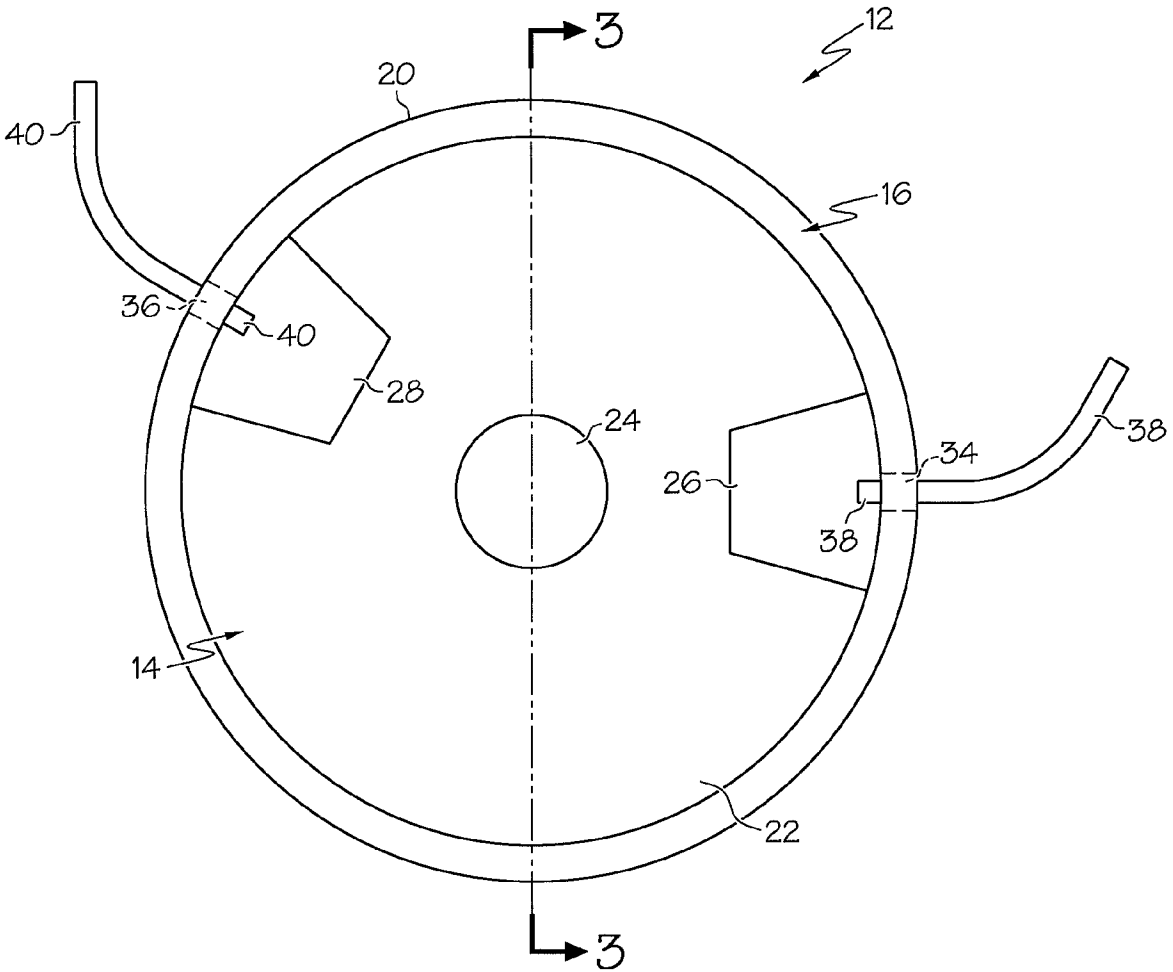
FIG. 2 is a bottom planar view of the tankhead assembly of FIG. 1 taken along lines 2-2 of FIG. 1 which also schematically shows how low and high motor speed electrical wiring is brought through the tankhead assembly.

Referring now to the drawings, FIGS. 1-4 show an embodiment of the present invention. A first expression of the embodiment of FIGS. 1-4 is for apparatus including a locomotive-radiator-cooling-fan tankhead assembly 12. The tankhead assembly 12 has a substantially-circular base plate 14 and a substantially-circular outer ring 16. The base plate 14 and the outer ring 16 each consist essentially of an aluminum alloy. A maximum diameter of the base plate 14 divided by a maximum thickness of the base plate 14 is between 5 and 15, and the maximum diameter of the base plate 14 divided by a maximum thickness of the outer ring 16 is between 20 and 30. The base plate 14 has a central longitudinal axis 18 and a circumference 20. The outer ring 16 is substantially coaxially aligned with the central longitudinal axis 18 and is attached to the base plate 14 proximate the circumference 20. The base plate 14 has a substantially-planar first surface 22 having a central recess 24 substantially coaxially aligned with the central longitudinal axis 18 and having circumferentially-separated, first and second peripheral recesses 26 and 28 each radially spaced apart from the central recess 24 and extending radially inward from proximate the circumference 20. The outer ring 16 longitudinally extends beyond the first surface 22. The tankhead assembly 12 is devoid of any gussets attached to the base plate 14 and is devoid of any gussets attached to the outer ring 16.

It is noted that the term "proximate" includes, but is not limited to, "at". In one arrangement, the base plate 14 and the outer ring 16 are separate components consisting essentially of (or consisting of) a same aluminum alloy. Arrangements having different aluminum alloys and arrangements having a monolithic tankhead assembly are left to the artisan.

In one enablement of the first expression of the embodiment of FIGS. 1-4, the outer ring 16 is welded to the base plate 14. In one variation, the outer ring 16 is adapted to contact and support radially-outwardly-extending, non-rotatable vanes 30. In one modification, the base plate 14 is adapted to contact and support a fan-motor stator assembly 32.

In one implementation of the first expression of the embodiment of FIGS. 1-4, the outer ring 16 has substantially-radially-extending first and second through holes 34 and 36, wherein the first through hole 34 abuts the first peripheral recess 26 and is adapted to receive low-motor-speed electrical wiring 38, and wherein the second through hole 36 abuts the second peripheral recess 28 and is adapted to receive high-motor-speed electrical wiring 40. In one variation, the first surface 22, apart from the first and second peripheral recesses 26 and 28, has a circumferential step 42, and the outer ring 16 abuts the circumferential step 42. In one modification, the first and second peripheral recesses 26 and 28 are non-diametrically opposed. In one illustration, the central recess 24 and the circumferential step 42 together have a radial extent less than twenty-five percent of the maximum diameter of the base plate 14. It is noted that, in this implementation, the maximum diameter of the base plate 14 is an outer diameter of the base plate which is not affected by the circumferential step 42. In one example, the first and second peripheral recesses 26 and 28 each have a radial extent less than thirty percent of the maximum diameter of the base plate 14.

In one construction of the first expression of the embodiment of FIGS. 1-4, the base plate 14 has a thickness at the circumferential step 42, at the central recess 24, and at the first and second peripheral recesses 26 and 28 which is substantially one-third the maximum thickness of the base plate 14. It is note that, in this construction, the maximum thickness of the base plate 14 is a substantially constant thickness of the base plate 14 apart from the central recess 24, the first and second peripheral recesses 26 and 28, and the circumferential step 42. In one design, the maximum diameter of the base plate 14 is between and including substantially 24 inches and substantially 26 inches. In this design, the outer ring 16 has a thickness of substantially 1.0 inch and a longitudinal length of substantially 4.62 inches. In this design, the maximum thickness of the base plate 14 is substantially 2.50 inches, and the central recess 24, the first and second recesses 26 and 28, and the circumferential step 42 each have a thickness of substantially 0.75 inches. In this design, the tankhead assembly weighs between and including 30 pounds and 35 pounds. In one choice of materials, base plate 14 and the outer ring 16 each consist of an aluminum alloy chosen from the group consisting of aluminum alloy 5052, aluminum alloy 6061, aluminum alloy 7075, aluminum alloy 3003, and aluminum alloy 2024.

Figure 3:
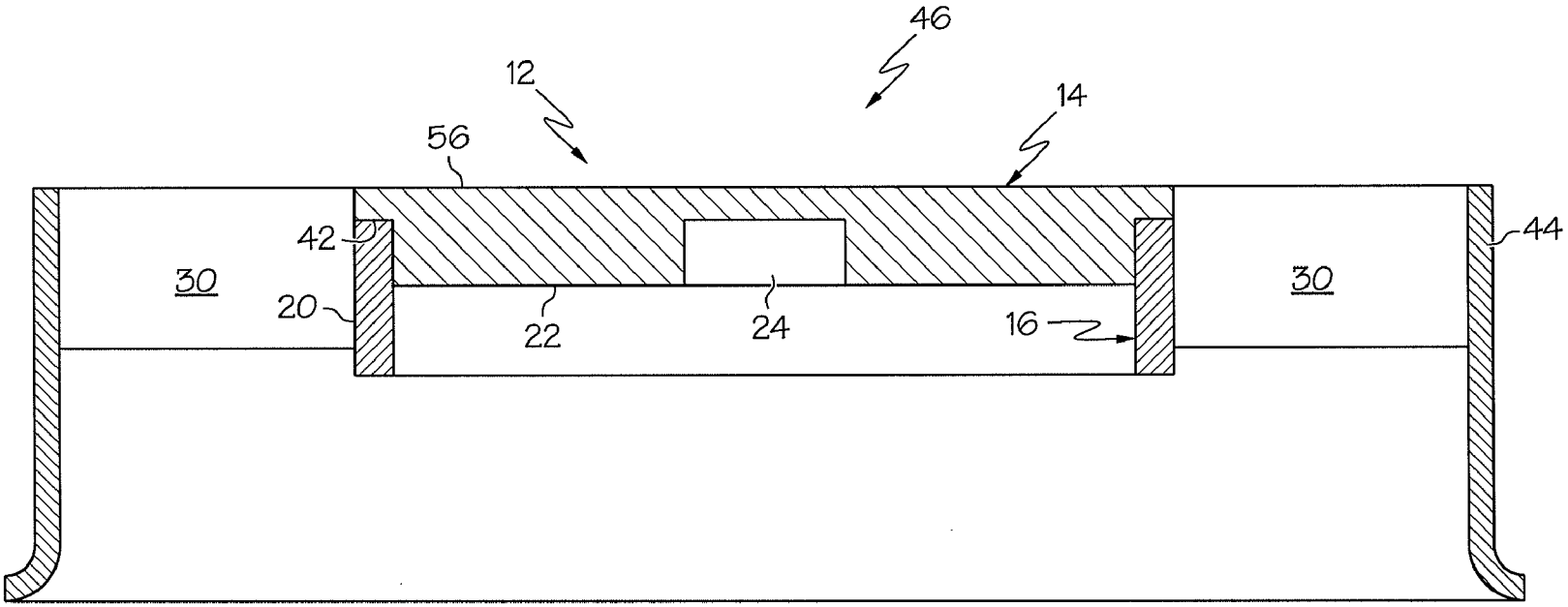
FIG. 3 is a cross-sectional view taken along lines 3-3 of FIG. 2 and turned upside down to match the orientation of FIG. 1 which shows how a plurality (only two are shown) of non-rotational vanes are welded to the outer ring of the tankhead assembly and how a fan-frame ring (with weldments for attachment to a locomotive omitted for clarity) surrounds and is welded to the non-rotational vanes to have FIG. 3 show an embodiment of a locomotive-radiator-cooling-fan frame assembly which includes the tankhead assembly of FIG. 1.

It is noted that the embodiment of FIG. 3 also shows vanes 30 welded to the outer ring 16 of the tankhead assembly 12 and a fan-frame ring 44 surrounding and welded to the vanes 30 to define an embodiment of an overall locomotive-radiator-cooling-fan frame assembly 46. It is also noted that the embodiment of FIG. 4 further shows a fan-motor stator assembly 32 attached to the base plate 14 by motor mounting bolts 48, a fan-motor rotor assembly 50, and a hub assembly 52 having a hub 53 attached to the fan-motor rotor assembly 50, having fan blades 54 (only two of which are shown) attached to the hub 53, and having a motor shaft 55 attached to the hub 53 and rotatably attached to the fan-motor stator assembly 32 to define an overall embodiment of a locomotive radiator cooling fan 10. In one application, not shown, the locomotive radiator cooling fan 10 is mounted to the roof of a locomotive chassis above a radiator of a diesel engine or an electric motor of the locomotive, with the substantially-planar second surface 56 of the base plate 14 oriented to face vertically upward.

A second expression of the embodiment of FIGS. 1-4 is for apparatus including a locomotive-radiator-cooling-fan tankhead assembly 12. The tankhead assembly 12 has a substantially-circular base plate 14 and a substantially-circular outer ring 16. The base plate 14 has a central longitudinal axis 18 and a circumference 20. The outer ring 16 is substantially coaxially aligned with the central longitudinal axis 18 and is attached to the base plate 14 proximate the circumference 20. The base plate 14 has a substantially-planar first surface 22 having a central recess 24 substantially coaxially aligned with the central longitudinal axis 18 and having circumferentially-separated, first and second peripheral recesses 26 and 28 each radially spaced apart from the central recess 24 and extending radially inward from proximate the circumference 20. The outer ring 16 longitudinally extends beyond the first surface 22. The tankhead assembly 12 is devoid of any gussets attached to the base plate 14 and is devoid of any gussets attached to the outer ring 16. In one illustration, the tankhead assembly 12 consists essentially of the base plate 14 and the outer ring 16. In one example, the tankhead assembly 12 consists of the base plate 14 and the outer ring 16.

In one choice of materials for the second expression of the embodiment of FIGS. 1-4, the base plate 14 and the outer ring 16 each consist essentially of (or consist of) steel. In another choice of materials, the base plate 14 and the outer ring 16 each consist essentially of (or consist of) a material which is lighter in weight than steel.

It is noted that the enablements, implementations, constructions, etc. of the first expression of the embodiment of FIGS. 1-4 are equally applicable to the second expression of the embodiment of FIGS. 1-4.

A third expression of the embodiment of FIGS. 1-4 is for apparatus including a locomotive-radiator-cooling-fan frame assembly 46 having the tankhead assembly 12, non-rotatable vanes 30 attached to and radially-outwardly-extending from the outer ring, and a fan-frame ring 44 radially-outwardly spaced apart from the outer ring 16 of the tankhead assembly 12 and attached to the vanes 30.

Figure 4:
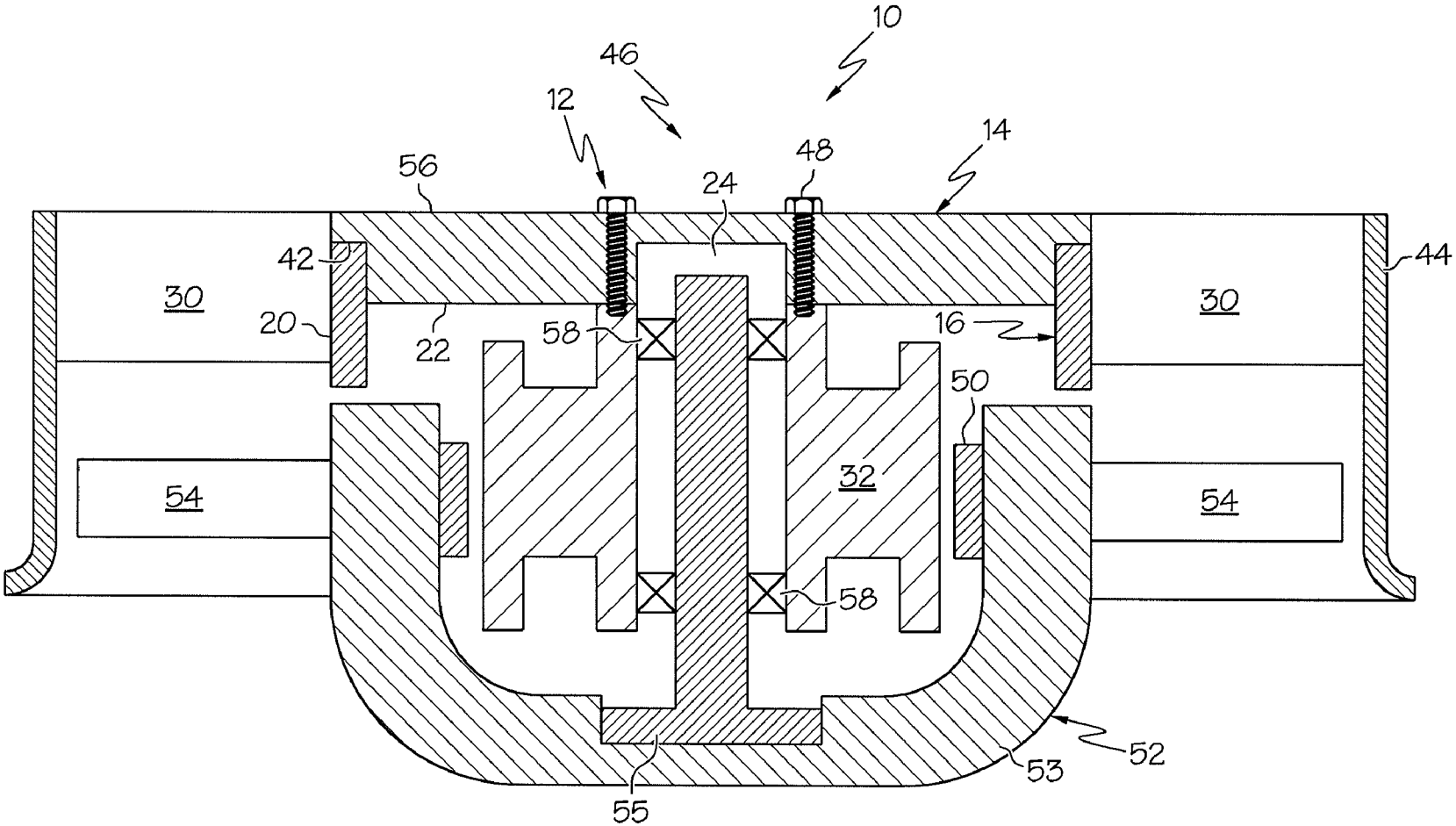
FIG. 4 is a view, as in FIG. 3, but with the addition of a fan motor and a hub assembly, wherein the fan-motor stator assembly of the fan motor is bolted to the base plate of the tankhead assembly, wherein the hub assembly includes the fan blades, and wherein the hub assembly is attached to the fan-motor rotor assembly of the fan motor to rotate with the fan-motor rotor assembly to have FIG. 4 show an embodiment of a locomotive radiator cooling fan which includes the tankhead assembly of FIG. 1.

A fourth expression of the embodiment of FIGS. 1-4 is for apparatus including a locomotive radiator cooling fan 10 having the locomotive-radiator-cooling-fan frame assembly 46, a fan-motor stator assembly 32 contacting and attached to the base plate 14, a fan-motor rotor assembly 50, and a hub assembly 52 having a hub 53 attached to the fan-motor rotor assembly 50, having fan blades 54 attached to the hub 53, and having a motor shaft 55 attached to the hub 53 and rotatably attached to the fan-motor stator assembly 32. It is noted that FIG. 4 shows bearings 58 rotatably attaching the fan-motor rotor assembly 50 to the fan-motor stator assembly 32 via intervening portions (i.e., the hub 53 and the motor shaft 55) of the hub assembly 52. In one example, the base plate 14 includes a radially-extending passageway 60 extending from the central recess 24 to one 26 of the first and second peripheral recesses 26 and 28 to allow air to escape during cooling fan assembly.

Several benefits and advantages are derived from one or both of the expressions of the embodiment of the invention. In one example, a lighter-weight tankhead assembly (and a lighter-weight locomotive radiator cooling fan) is provided using an aluminum alloy (or other lighter-weight material than conventional steel). It is noted that applicants' shock and vibration testing of a conventional locomotive radiator cooling fan, having a conventional tankhead assembly design, which replaced the steel with an aluminum alloy for the tankhead assembly, the vanes, the fan-frame ring, and the hub assembly including the blades resulted in the tankhead assembly exhibiting a wobble mode during a static (motor switched off) vibration test of the cooling fan, wherein the test subjected the cooling fan to eight hours of 2-g load vibration at resonance frequencies and resulted in undesirable contact of the fan blade tips with the surrounding fan-frame ring. It is also noted that the same test using the tankhead assembly design of the first expression of the embodiment of the invention together with thicker vanes resulted a greatly reduced wobble mode without any contact of the fan blade tips with the surrounding fan-frame ring.

The foregoing description of several expressions of an embodiment of the invention has been presented for purposes of illustration. It is not intended to be exhaustive or to limit the invention to the precise form disclosed, and obviously many modifications and variations are possible in light of the above teaching. It is intended that the scope of the invention be defined by the claims appended hereto.

The invention claimed is:

1. Apparatus comprising a locomotive-radiator-cooling-fan tankhead assembly having a substantially-circular base plate and a substantially-circular outer ring, wherein the base plate and the outer ring each consist essentially of an aluminum alloy, wherein a maximum diameter of the base plate divided by a maximum thickness of the base plate is between 5 and 15, and wherein the maximum diameter of the base plate divided by a maximum thickness of the outer ring is between 20 and 30, wherein the base plate has a central longitudinal axis and a circumference, wherein the outer ring is substantially coaxially aligned with the central longitudinal axis and is attached to the base plate proximate the circumference, wherein the base plate has a substantially-planar first surface having a central recess substantially coaxially aligned with the central longitudinal axis and having circumferentially-separated, first and second peripheral recesses each radially spaced apart from the central recess and extending radially inward from proximate the circumference, wherein the outer ring longitudinally extends beyond the first surface, and wherein the tankhead assembly is devoid of any gussets attached to the base plate and is devoid of any gussets attached to the outer ring.

2. The apparatus of claim 1, wherein the outer ring is welded to the base plate.

3. The apparatus of claim 2, wherein the outer ring is adapted to contact and support radially-outwardly-extending, non-rotatable vanes.

4. The apparatus of claim 3, wherein base plate is adapted to contact and support a fan-motor stator assembly.

5. The apparatus of claim 1, wherein the outer ring has substantially-radially-extending first and second through holes, wherein the first through hole abuts the first peripheral recess and is adapted to receive low-motor-speed electrical wiring, and wherein the second through hole abuts the second peripheral recess and is adapted to receive high-motor-speed electrical wiring.

6. The apparatus of claim 5, wherein the first surface, apart from the first and second peripheral recesses, has a circumferential step, and wherein the outer ring abuts the circumferential step.

7. The apparatus of claim 6, wherein the first and second peripheral recesses are non-diametrically opposed.

8. The apparatus of claim 7, wherein the central recess and the circumferential step together have a radial extent less than twenty-five percent of the maximum diameter of the base plate.

9. The apparatus of claim 8, wherein the first and second peripheral recesses each have a radial extent less than thirty percent of the maximum diameter of the base plate.

10. The apparatus of claim 1, wherein the base plate has a thickness at the circumferential step, at the central recess, and at the first and second peripheral recesses which is substantially one-third the maximum thickness of the base plate.

11. Apparatus comprising a locomotive-radiator-cooling-fan tankhead assembly having a substantially-circular base plate and a substantially-circular outer ring, wherein the base plate has a central longitudinal axis and a circumference, wherein the outer ring is substantially coaxially aligned with the central longitudinal axis and is attached to the base plate proximate the circumference, wherein the base plate has a substantially-planar first surface having a central recess substantially coaxially aligned with the central longitudinal axis and having circumferentially-separated, first and second peripheral recesses each radially spaced apart from the central recess and extending radially inward from proximate the circumference, wherein the outer ring longitudinally extends beyond the first surface, and wherein the tankhead assembly is devoid of any gussets attached to the base plate and is devoid of any gussets attached to the outer ring.

12. The apparatus of claim 11, wherein the outer ring is welded to the base plate.

13. The apparatus of claim 12, wherein the outer ring is adapted to contact and support radially-outwardly-extending, non-rotatable vanes.

14. The apparatus of claim 13, wherein base plate is adapted to contact and support a fan-motor stator assembly.

15. The apparatus of claim 11, wherein the outer ring has substantially-radially-extending first and second through holes, wherein the first through hole abuts the first peripheral recess and is adapted to receive low-motor-speed electrical wiring, and wherein the second through hole abuts the second peripheral recess and is adapted to receive high-motor-speed electrical wiring.

16. The apparatus of claim 15, wherein the first surface, apart from the first and second peripheral recesses, has a circumferential step, and wherein the outer ring abuts the circumferential step.

17. The apparatus of claim 16, wherein the first and second peripheral recesses are non-diametrically opposed.

18. The apparatus of claim 17, wherein the central recess and the circumferential step together have a radial extent less than twenty-five percent of the maximum diameter of the base plate.

19. The apparatus of claim 18, wherein the first and second peripheral recesses each have a radial extent less than thirty percent of the maximum diameter of the base plate.

20. The apparatus of claim 11, wherein the base plate has a thickness at the circumferential step, at the central recess, and at the first and second peripheral recesses which is substantially one-third the maximum thickness of the base plate.

* * * * *